United States Patent [19]

Westberg

[11] 4,278,202

[45] Jul. 14, 1981

[54] CENTRIFUGE ROTOR AND COLLAPSIBLE SEPARATION CONTAINER FOR USE THEREWITH

[75] Inventor: Johan E. H. Westberg, Lidingö, Sweden

[73] Assignee: Separek Teknik AB, Stockholm, Sweden

[21] Appl. No.: 60,819

[22] Filed: Jul. 25, 1979

[30] Foreign Application Priority Data

Jul. 25, 1978 [SE] Sweden ..... 7808129

[51] Int. Cl.[3] ..... B04B 1/00; B04B 5/00

[52] U.S. Cl. ..... 233/27; 210/927

[58] Field of Search ..... 233/27, 26, 1 R, 1 A, 233/1 E, 1 D; 210/DIG. 23; 128/2 F, 2 G

[56] References Cited

U.S. PATENT DOCUMENTS

| | | | |
|---|---|---|---|
| 2,883,103 | 4/1959 | Whitehead et al. | 233/27 |
| 3,326,458 | 6/1967 | Meryman et al. | 233/27 |
| 3,708,110 | 1/1973 | Unger | 233/26 |
| 3,724,747 | 4/1973 | Unger et al. | 233/26 X |
| 3,748,101 | 7/1973 | Jones et al. | 233/26 X |
| 4,007,871 | 2/1977 | Jones et al. | 233/27 |
| 4,010,894 | 3/1977 | Kellogg et al. | 233/26 X |

*Primary Examiner*—Stanley N. Gilreath

*Attorney, Agent, or Firm*—Hill, Van Santen, Steadman, Chiara & Simpson

[57] ABSTRACT

A centrifuge rotor for use in the continuous separation of a liquid into fractions has a recess for receiving a flow-through separation container. The recess has interrupted annular shape with inclined side-walls. The inclination of the sidewalls and the cross-sectional area of the recess increase continuously in the circumferential direction from one end of the recess to the other. A collapsible flow-through separation container having flexible inlet and outlet tubes is adapted to fit within the rotor recess. Its cross-sectional area increases continuously from the inlet end to the outlet end.

6 Claims, 3 Drawing Figures

CENTRIFUGE ROTOR AND COLLAPSIBLE SEPARATION CONTAINER FOR USE THEREWITH

BACKGROUND OF THE INVENTION

1. Field of the Invention

This invention relates to the centrifugal separation of liquids and more particularly to an improved centrifuge rotor and to an improved collapsible container for use in such centrifuge rotor. The invention is particularly useful in the centrifuge system disclosed in my copending patent application Ser. No. 930,389 filed Aug. 2, 1978, which is incorporated herein by reference, but it will be understood that the invention is advantageously applicable to other types of centrifuges as well.

SUMMARY OF THE INVENTION

The invention is concerned with continuous or flow-through centrifugal separation, and its main features are:

(1) utilization of the so-called angle effect with the angle continuously increasing from the inlet end to the outlet end of the flow-through separation container, and (2) the cross-sectional area of the separation container increasing from the inlet end to the outlet end.

These features provide for a more efficient separation of the fractions of the centrifuged liquid.

For a more complete understanding of the invention an embodiment thereof is described with reference to the drawings, it being understood that the embodiment illustrated herein is intended as merely exemplary and not limitative.

A BRIEF DESCRIPTION OF THE DRAWINGS

DETAILED DESCRIPTION

Figure 1:
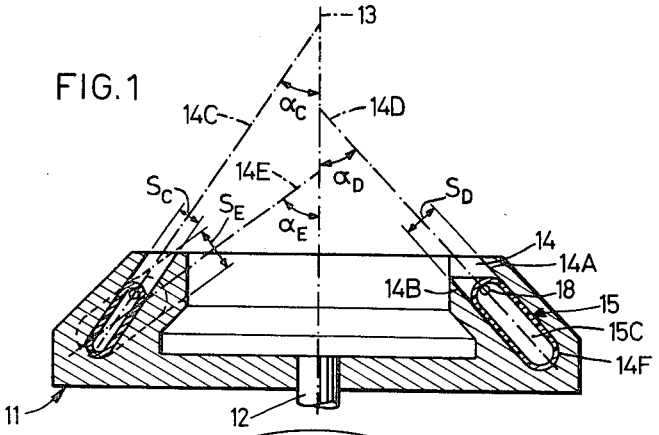
FIG. 1 is a view in axial section of a centrifuge rotor and separation container embodying the invention, the section being taken on line I—I of FIG. 2.
Figure 2:
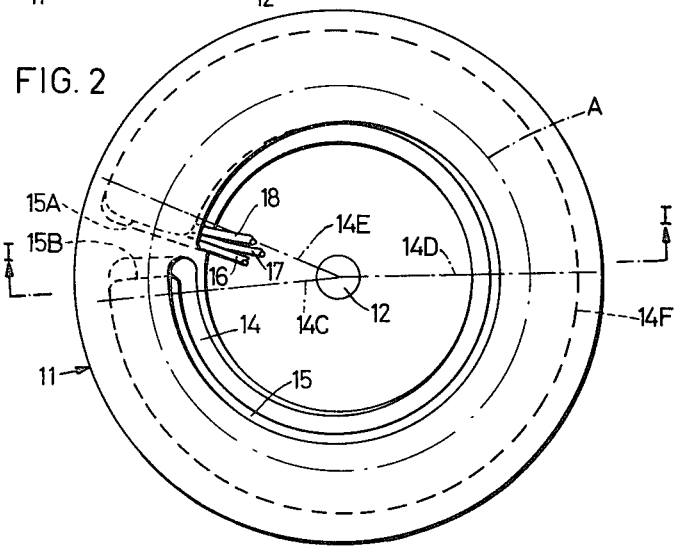
FIG. 2 is a plan view of the rotor and the container shown in FIG. 1.
Figure 3:
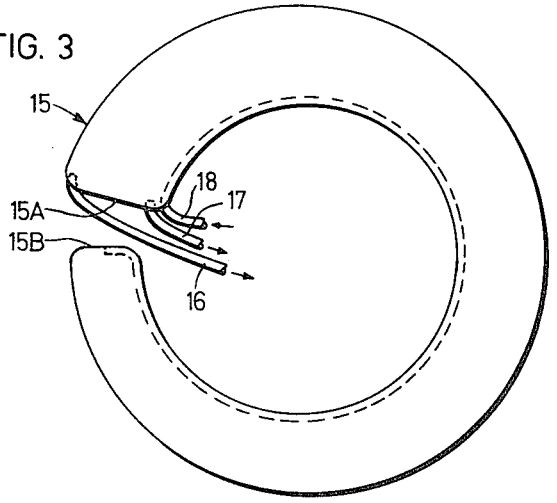
FIG. 3 is a plan view of the separation container when removed from the rotor.

As shown on the drawing the rotor 11 is mounted on a shaft 12 rotatable about a vertical axis 13 by means of a suitable motor (not shown). A recess 14 for receiving a collapsible separation container is in the form of an interrupted annulus extending along a circular axis A centered on the axis 13. As best shown in FIG. 2, the recess extends slightly less than a full turn about the vertical axis 13. Viewed in axial section as in FIG. 1 the opposed sidewalls 14A and 14B of the recess 14 are generally parallel and inclined upwardly and inwardly. In FIGS. 1 and 2, the center lines 14C, 14D, 14E of three radial cross-sections of the recess 14 are extended so as to intersect the vertical axis 13.

The acute angle included between the vertical axis 13 and the center line of the radial cross-sections of the recess 14 increases gradually in the circumferential direction from a minimum value $\alpha_C$ near one end of the recess (at the intersection of center line 14C with circular axis A) over an intermediate value $\alpha_D$ halfway between the ends (at the intersection of center line 14D with circular axis A) to a maximum value $\alpha_E$ near the other end (at the intersection of center line 14E with circular axis A) of the recess. The cross-sectional area of the recess 14 increases gradually in the same manner; as shown in FIG. 1, the distance separating the sidewalls 14A, 14B increases from a minimum value $S_C$ near the first-mentioned end of the recess 14 over an intermediate value $S_D$ to a maximum value $S_E$ near the other end of the recess.

The bottom 14F of the recess 14 generally follows a spiral line, and thus its distance from the vertical axis 13 increases gradually from the first-mentioned end of the recess to the other. In similar manner the top portion of the recess 14 gradually approaches the vertical axis 13 from the first end to the other.

The collapsible separation container, which is designated 15, is made from a flexible pliable plastic sheet material such as polyvinyl chloride. It is formed by a length of tube or hose the opposite ends 15A and 15B of which are closed. The cross-sectional area of its lumen 15C (FIG. 1) increases gradually from one end 15B, the inlet end, towards the opposite end 15A, the outlet end. When the container 15 is received in the recess 14 as shown in FIGS. 1 and 2 the outlet end 15A is disposed near the end of the recess having the largest cross-sectional area and the inlet end 15B is disposed near the end of the recess having the smallest cross-sectional area. The elongated double-ended shape of the container facilitates the insertion of the container in the rotor 11 and its removal therefrom. This is true even if the recess 14 is uninterrupted, that is, endless.

Three flexible tubes 16, 17, 18 are attached to the closed container 15 near the outlet end 15A. The tubes 16 and 17 open into the container at that end, near respectively the radially outermost region and the radially innermost region, and serve as outlet tubes to withdraw respectively a heavy fraction and a light fraction from the container. The third tube 18 is an inlet tube which extends circumferentially within the container or on the outer side to the inlet end 15B where it opens into the container approximately halfway between the radially innermost and radially outermost regions of the container.

As a consequence of the varying angle of inclination of the radially outer wall 14A of the recess 14 and the resulting varying inclination of the radially outer wall of the separation container 15 received in the recess, the fractions into which the liquid (e.g. blood) is fed into the container 15 through the tube 18 is separated, are subjected to forces tending to cause the fractions to flow towards that end 15A of the separation container where the outlet tubes 16, 17 communicate with the interior of the separation container. In this way a particularly efficient separation is achieved.

As a consequence of the increasing cross-sectional area the rate of flow in the longitudinal or circumferential direction of the separation container 15 decreases gradually from the inlet end 15B towards the outlet end 15A so that the risk of unwanted intermixing of the separated fractions is minimized.

I claim as my invention:

1. A centrifuge rotor having a recess for receiving a separation container and extending along a circular axis centered on the axis of rotation of the rotor, the radially outer sidewall of the recess being inclined with respect to the axis of rotation of the rotor so that during rotation of the rotor centrifugal separation of liquid contents of a collapsible separation container received in the recess takes place under the influence of the angle effect, the angle of inclination of the radially outer sidewall of the recess increasing from a minimum value at a first point on the circular axis to a maximum value at a second point on the circular axis located near the first point.

2. A centrifuge rotor according to claim 1, the cross-sectional area of the recess as measured in a plane containing the axis of rotation of the rotor being larger in the region of said second point than in the region of said first portion.

3. A centrifuge rotor according to claim 2, the radially outer and radially inner sidewalls of the recess as viewed in a sectional plane containing the axis of rotation of the rotor being substantially straight and parallel, and the distance separating said sidewalls being larger in the region of said second point than the region of said first point.

4. A separation unit including in combination, a centrifuge rotor according to claim 1, and a tubular container of flexible sheet material having tubes attached thereto for conveying liquid into and out of the container, said container having closed ends and having a lumen with a cross-sectional area being enlarged at one of said ends.

5. A separation unit according to claim 4, said recess being a frustoconical pocket defined in part by said inclined sidewall, said closed ends of said container being unattached to each other to define external ends free of each other, whereby insertion of said container into said frustoconical pocket is facilitated.

6. A collapsible container for use in a centrifuge rotor having a conical pocket receptive of the container, said container being made of flexible sheet material, and having tubes attached thereto for conveying liquid into and out of the container, said container comprising a length of tube or hose having the opposite ends thereof closed and free of each other, the cross-sectional area of the lumen of the length of tube or hose being enlarged at one of said opposite ends; said tubes for conveying liquid into and out of said chamber including a plurality of outlet tubes communicating with the container at said one enlarged end and an inlet tube entering said container at said one enlarged end but communicating with the interior of said container adjacent the opposite end, all said tubes being secured to said container at said one enlarged end.

* * * * *